US005120614A

United States Patent [19]

Hibner et al.

[11] Patent Number: 5,120,614

[45] Date of Patent: Jun. 9, 1992

[54] CORROSION RESISTANT NICKEL-BASE ALLOY

[75] Inventors: Edward L. Hibner, Ona; Ralph W. Ross, Jr., Huntington; James R. Crum, Ona, all of W. Va.

[73] Assignee: Inco Alloys International, Inc., Huntington, W. Va.

[21] Appl. No.: 260,982

[22] Filed: Oct. 21, 1988

[51] Int. Cl.[5] ..... B32B 15/01; C22C 19/05

[52] U.S. Cl. ..... 428/679; 428/680; 420/445; 420/448; 420/451; 420/453; 420/584.1; 148/427; 148/428

[58] Field of Search ..... 420/445, 446, 447, 448, 420/451, 453, 584; 148/409, 410, 427, 428; 428/679, 680, 678

[56] References Cited

U.S. PATENT DOCUMENTS

| | | | |
|---|---|---|---|
| 3,160,500 | 12/1964 | Eiselstein et al. | 420/448 |
| 3,203,792 | 8/1965 | Scheil et al. | 420/454 |
| 3,510,294 | 5/1970 | Bieber et al. | 420/448 |
| 4,043,810 | 8/1977 | Acuncius et al. | 148/162 |
| 4,080,201 | 3/1978 | Hodge et al. | 148/162 |
| 4,129,464 | 12/1978 | Matthews et al. | 148/162 |
| 4,168,188 | 9/1979 | Asphahani | 148/11.5 N |
| 4,172,716 | 10/1979 | Abo et al. | 420/41 |
| 4,245,698 | 1/1981 | Berkowtiz et al. | 148/11.5 N |
| 4,410,489 | 10/1983 | Asphahani et al. | 420/453 |
| 4,443,406 | 4/1984 | Sukekawa et al. | 420/584 |
| 4,464,210 | 8/1984 | Watanabe | 148/410 |
| 4,533,414 | 8/1985 | Asphahani | 148/427 |

OTHER PUBLICATIONS

Manning, P. E., Sridhar, N. and Asphahani, A. I., New Developmental NiCrMo Alloys, Paper before Int. Corr. Forum sponsored by NACE, Anaheim, Calif., Apr. 18-22, 1983, pp. 21/1-21/14.

*Primary Examiner*—R. Dean
*Assistant Examiner*—Margery S. Phipps
*Attorney, Agent, or Firm*—Francis J. Mulligan, Jr.; Edward A. Steen

[57] ABSTRACT

A nickel-chromium-molybdenum-niobium alloy affords high resistance to aggressive corrosives, including chlorides which cause crevice corrosion and oxidizing acids which promote intergranular corrosion, the alloy also being readily weldable and possessing structural stability at very low as well as elevated temperatures. The alloy consists essentially of, (by weight), 19-23% Cr, 12-15% Mo, 2.25-4% W, 0.65-2% Nb, 2-8% Fe, balance Ni.

7 Claims, No Drawings

CORROSION RESISTANT NICKEL-BASE ALLOY

The subject invention is directed to a nickel-chromium-molybdenum-niobium alloy which affords a combination of exceptionally high resistance to various subversive corrosive media together with satisfactory weldability, stability, strength, etc.

INVENTION BACKGROUND

As is well known, nickel-chromium-molybdenum alloys are extensively used commercially by reason of their ability to resist the ravages occasioned by the aggressive attack of various corrosives, notably chlorides which cause crevice corrosion and oxidizing acids which promote intergranular corrosion. Alloys of this type are commonly used in the more severe corrosive environments and usually must be welded to provide desired articles of manufacture, e.g., tubing, large containers/vessels, etc. As such and in use, these articles are exposed to elevated temperatures and this gives rise to a problem of additional concern, to wit, corrosive attack at the weld and/or heat affected zone (HAZ). This problem is well known to, for example, the chemical process industry where more than passing attention is given to the gravity of attack.

To determine the likelihood of intergranular attack an ASTM test (G-28) is often use whereby an alloy is exposed to a temperature of circa 1400°-1700° F. (760°-927° C.) prior to exposure in given corrosives to ascertain its propensity to undergo attack. It is often referred to as a "sensitizing" temperature, i.e., a temperature deemed "sensitive" in predicting attack. There are two ASTM G-28 tests, the ASTM G-28 Method "B" test being deemed more reliable in determining this "sensitivity" as opposed to the ASTM G-28 Method "A" Test.

INVENTION SUMMARY

In any case, it has now been found that a nickel-base alloy containing correlated percentages of chromium, molybdenum, tungsten and niobium offers an excellent level of corrosion resistance as reflected by the standard ASTM G-28 Modified "B" Test. Moreover, provided the alloy chemistry is properly balanced, the alloy obtains a good combination of weldability, workability, strength, etc. Also of importance it has been determined that the alloy is most suitable for forming clad metal products, i.e., as cladding to steel. Furthermore, the structural stability of the alloy is excellent at low temperatures, thus rendering the alloy potentially suitable at cryogenic temperatures.

In addition to the foregoing, it has been found that the alloy is not adversely affected over a desired range of heat treatment temperature. In terms of an annealing treatment it has been found that temperatures of 2000° F. (1093° C.) and up at least to 2200° F. (1204° C.) can be utilized. This means that mill products, e.g., sheet, strip, plate, etc. can be made softer such they are more amenable to forming operations such as bending and the like. A temperature such as 2000° F. is also beneficial in striving for optimum tensile strength.

INVENTION EMBODIMENTS

Generally speaking and in accordance herewith, the present invention contemplates a highly corrosion-resistant, nickel-base alloy containing about 19 to 23% chromium about 12 to 15% molybdenum, about 2.25 to 4% tungsten, about 0.65 to less than 2% niobium, about 2 to 8% iron, up to less than 1% manganese, less than 0.5% silicon, carbon up to 0.1%, up to 0.5% aluminum, up to 0.5% titanium and the balance being essentially nickel.

In terms of the alloying constituents chromium is important in conferring general corrosion resistance. Below about 19% resistance drops off whereas much above 23% undesired morphological phases can form particularly at the higher molybdenum and niobium levels. A chromium range of 20 to 22.5% is deemed quite satisfactory. Molybdenum imparts resistance to pitting and is most beneficial in achieving desired critical crevice corrosion temperatures (CCT). Critical crevice temperature is important because it is a relatively reliable indicator as to the probability for an alloy to undergo crevice corrosion attack in chloride solutions, the higher the temperature the better. (A 6% $FeCl_3$ solution is often used for test purposes). It is preferred that molybdenum be from 12.5 to 14.5%. Excessive molybdenum, say 16%, particularly with high chromium-niobium-tungsten levels, promotes instability through the formation of undesirable structural phases, e.g., Mu, whereas levels below, say, 12% detract from corrosion behavior.

Tungsten has a beneficial effect on weldability, enhances acid-chloride crevice-corrosion resistance and is considered to lend to imparting resistance to stress-corrosion cracking (SCC) of the type that occurs in deep sour gas wells (DSGW). It has also been noted that it increases the resistance to surface cracking due to carbon diffusion during heat treating to simulate cladding to steel. Tungsten levels of, say, 1.5-2% are inadequate and percentages above 4% are unnecessary. A range of 2.75 to 4% is advantageous.

Niobium enhances acid-chloride crevice corrosion resistance as will be shown in connection with the ASTM G-28, Modified "B" test and is deemed to offer greater resistance to SCC in deep sour gas wells. However, in amounts of 2% it tends to impair weldability and is detrimental to crevice-corrosion resistance in, for example, concentrated hydrofluoric acid. It should be maintained below about 1.5%, a range of 0.75 to about 1.25% being satisfactory.

In terms of other constituents, titanium detracts from desired properties and preferably should not exceed 0.5%. Carbon advantageously should be maintained below 0.03% and preferably below 0.015 or 0.01%. Aluminum is beneficial for deoxidation and other purposes but it need not exceed 0.5%, a range of 0.05 to 0.3% being suitable. Silicon should be held to low levels, e.g., below 0.3%. The iron content is preferably from 3 to 6%.

The following information and data are given to afford those skilled in the art a better perspective as to the nature of the alloy above described.

In Table I below are given the compositions of the alloy of the present invention (Alloy 1) and an excellent commercial alloy (Alloy A). In respect of Alloy 1 a 30,000 pound melt was prepared using vacuum induction melting followed by electroslag remelting. Alloy 1 was hot worked to 0.25 inch plate specimens which were then tested in various conditions as reported in Table II. In this connection "mill annealed" plate was cold rolled (CR) and/or heat treated to ascertain the effects of thermomechanical processing on corrosion resistance. Alloy A was tested as 0.25 inch plate.

Both ASTM G-28 Method "A" and Method "B" corrosion tests were employed. The Method "B" test, as indicated previously, is deemed more sensitive than "A", and more reliably identifies microstructures responsible for reduced intergranular corrosion and localized corrosion resistance.

TABLE I

| | Chemical Compositions* | | | | | | | | | | | |
|---|---|---|---|---|---|---|---|---|---|---|---|---|
| Alloy | C | Mn | Fe | Si | Ni | Cr | Al | Ti | Co | Mo | Nb | W |
| 1 | .006 | .23 | 4.60 | .06 | 55.38 | 21.58 | .15 | .02 | .48 | 13.62 | .75 | 3.11 |
| A | .004 | .26 | 5.07 | .06 | 55.96 | 21.31 | .21 | .02 | .49 | 13.17 | n.a. | 3.02 |

n.a. - not added

*Alloys contained Mg and impurities

TABLE II

| IGA Test Results - 24 Hour Exposure | | | | | |
|---|---|---|---|---|---|
| | | Corrosion Rate, mpy | | | |
| | | ASTM G-28, Practice A | | ASTM G-28, Practice B | |
| Condition | Product | Alloy 1 | Alloy A | Alloy 1 | Alloy A |
| CR 40% + 1900° F./½ Hr. WQ + 1600° F./1 Hr. AC | 0.250" Plate | 63 | 51 | 1676 | 2658 |
| CR 40% + 1950° F./½ Hr. WQ + 1600° F./1 Hr. AC | " | 64 | 55 | 1741 | 2527 |
| CR 40% + 2000° F./½ Hr. WQ + 1600° F./1 Hr. AC | " | 81 | 52 | 1711 | 2545 |
| CR 40% + 2050° F./½ Hr. WQ + 1600° F./1 Hr. AC | " | 107 | 45 | 25 | 2117 |
| CR 40% + 2100° F./½ Hr. WQ + 1600° F./1 Hr. AC | " | 83 | 44 | 21 | 84 |
| CR 40% + 2150° F./½ Hr. WQ + 1600° F./1 Hr. AC | " | 79 | 41 | 18 | 74 |
| Mill Anneal | " | 39 | 32 | 6 | 5 |
| Mill Anneal + 1200° F./1 Hr. AC | " | 36 | 34 | 6 | 6 |
| Mill Anneal + 1400° F./1 Hr. AC | " | 49 | 46 | 26 | 89 |
| Mill Anneal + 1600° F./1 Hr. AC | " | 62 | 45 | 1372 | 1652 |
| Mill Anneal + 1800° F./1 Hr. AC | " | 68 | 37 | 21 | 52 |
| Mill Anneal + 2000° F./1 Hr. AC | " | 36 | 32 | 6 | 5 |
| Mill Anneal + CR 50% + 1700° F./7 Min., WQ | " | 51 | — | 2273 | — |
| Mill Anneal + CR 50% + 1800° F./7 Min., WQ | " | 54 | — | 2602 | — |
| Mill Anneal + CR 50% + 1900° F./7 Min., WQ | " | 47 | — | 8 | — |
| Mill Anneal + CR 50% + 1950° F./7 Min., WQ | " | 42 | — | 6 | — |
| Mill Anneal + CR 50% + 2000° F./7 Min., WQ | " | 41 | — | 6 | — |

The data in Table II reflect that in respect of the more sensitive ASTM "B" test, Alloy 1 performed better than Alloy A. The effect of annealing temperature after cold rolling on resistance to subsequent sensitization at 1600° F. is shown in the first set of data. Test "B" shows that resistance to sensitization is founded by an anneal at 2050° F. (1138° C.) or higher for Alloy 1 and 2100° F. (1149° C.) anneal or higher for Alloy A. This difference in effective stabilizing anneals is considered to be a reflection of the 0.75 niobium in Alloy 1. The inability of Method A to detect sensitization of either alloy in this series of tests confirms that ASTM G-28 Method A is not as good a barometer for this type of alloy. It might be added that the ability to use a low annealing temperature (2050° F./1121° C. versus 2100° F./1149° C.) lends to higher strength.

The mill anneal temperature for Alloy 1 of the second group of data was 2100° F. and 2050° F. for Alloy A. Again, the Method A test was virtually insensitive in respect of either alloy over the 1400°-2000° F. (760°-1093° C.) sensitizing temperature range whereas ASTM "B" resulted in severe sensitization at the 1600° F. temperature. Microstructures were examined, and heavy intergranular precipitation was observed.

Alloy 1 was further tested under a third processing condition as shown in Table II, i.e., mill anneal plus a 50% cold roll followed by 1700° to 2000° F. anneals. Method "A" was again insensitive. In marked contrast, Test "B" resulted in considerable attack with the 1700° and 1800° F. anneals.

Apart from the above, critical crevice corrosion temperature data are given for Alloy 1 in Table III in a 10.8% $FeCl_3$ solution.

TABLE III

| Alloy | Conditon | Critical Crevice Temperature |
|---|---|---|
| 1 | mill anneal, 2100° F. | 55° C. |
| 1 | m.a., CR 50% + 1800° F./7 min., W.Q. | <45° C. |
| 1 | m.a., CR 50% + 2000° F./7 min., W.Q. | 55° C. |

The data in Table III reflect that an 1800° F. anneal is too low whereas the mill anneal (2100° F.) and 2000° F. anneal gave excellent CCT results.

In Table V additional critical crevice corrosion temperature data are given for several alloys including Alloy A and the present invention, the chemical compositions being set forth in Table IV. A 6% Fe Cl solution was used for test and evaluation purposes. Alloys 2-5 are within the invention whereas A-G are outside the invention. Commercial Alloys 625 and C-276 are included for comparison purposes.

TABLE IV

| Alloy | C | Mn | Fe | Ni | Cr | Al | Ti | Co | Mo | Nb | W | Other |
|---|---|---|---|---|---|---|---|---|---|---|---|---|
| 2 5608 | 0.002 | 0.04 | 3.21 | 57.87 | 20.81 | 0.27 | 0.27 | 0.01 | 13.70 | 0.79 | 2.92 | |
| 3 5787 | 0.003 | 0.25 | 4.16 | 56.10 | 21.55 | 0.20 | 0.03 | 0.01 | 13.72 | 0.82 | 2.98 | |
| 4 5790 | 0.003 | 0.25 | 4.15 | 55.58 | 21.76 | 0.21 | 0.04 | 0.51 | 13.85 | 0.75 | 2.60 | |
| 5 5791 | 0.003 | 0.26 | 4.17 | 55.09 | 21.65 | 0.20 | 0.02 | 0.51 | 13.74 | 1.02 | 3.00 | |
| A 5789 | 0.006 | 0.23 | 4.60 | 55.96 | 21.31 | 0.21 | 0.02 | 0.49 | 13.17 | n.a. | 3.02 | |
| B 5391 | 0.004 | 0.1 | 4.3 | 59.14 | 19.96 | 0.22 | 0.26 | 0.58 | 13.16 | 1.09 | 0.96 | — |
| C 5609 | 0.021 | 0.03 | 3.53 | 56.48 | 20.78 | 0.31 | 0.26 | 0.01 | 13.74 | 0.78 | 3.22 | 0.52 Ta |
| D 5392 | 0.003 | 0.09 | 3.15 | 58.55 | 20.95 | 0.20 | 0.26 | 0.01 | 13.66 | 2.09 | 1 | — |
| E 5393 | 0.004 | 0.09 | 3.18 | 58.44 | 21.05 | 0.21 | 0.26 | 0.01 | 13.66 | 1.17 | 1.93 | — |
| F 5792 | 0.003 | 0.27 | 4.20 | 55.59 | 21.66 | 0.21 | 0.78 | 0.30 | 13.85 | 0.07 | 2.73 | 0.78 Ti |
| G 5481 | 0.003 | 0.01 | 1.91 | 58.37 | 21.16 | 0.24 | 0.25 | 0.01 | 13.68 | 2.09 | 1.99 | — |

TABLE V

| Alloy | Critical Crevice Temperature, °C. |
|---|---|
| 2 | 55.0; 55.0 |
| 3 | 55.0; 55.0 |
| 4 | 55.0; 55.0 |
| 5 | 55.0; 55.0 |
| A | 55.0; 55.0 |
| B | 42.5; 42.5 |
| C | 47.5; 47.5 |
| D | 47.5; 47.5 |
| E | 47.5; 47.5 |
| F | 50.0; 50.0 |
| G | 52.5; 52.5 |
| Alloy 625 | 25.0 to 30.0 |
| Alloy C-276 | 45.0 to 50 |

It will be observed that the alloys within the invention all had higher critical crevice corrosion temperatures than the alloys outside the invention save Alloy A. Alloys D and G contained marginally high niobium and Alloys such as B and D suffered from a deficiency of tungsten. Alloy F reflects that Ti is not a substitute for niobium.

With regard to weldability behavior alloys both within and without the invention (Table VI) were tested using gas metal arc welding (GMAW) procedures. This technique was used to evaluate HAZ microfissuring sensitivity because of its potency in producing this form of cracking as a consequence of its high heat input, shallow thermal gradients and high deposition rate. HAZ microfissuring is a problem particularly in respect of high alloy nickel-base alloys. It occurs as a result of macrosegregation and thermal gradients during welding.

One-half inch plates (Alloys 1, 2 and C) were prepared by annealing at 2100° F. (1149° C.)/1 hr. followed by air cooling. The edges of two 4-inch lengths of plate from each heat were beveled to 30 degrees for welding access. Two plates from each heat were prepared and welded down to a strong back for full restraint. The weld joint was produced using 0.035 inch diameter INCONEL ® alloy 625 filler metal in the spray transfer mode. The welding parameters were 200 amps, a 550 inches/min. wire speed, a voltage of 32.5 volts and 60 cfh argon as a shield. The weld faces were ground flush to the base metal, polished to 240 grit and liquid penetrant inspected for the presence of large microfissures.

TABLE VI

| Alloy | C | Fe | Ni | Cr | Al | Ti | Mo | Nb | W |
|---|---|---|---|---|---|---|---|---|---|
| 1 | .006 | 4.60 | 55.38 | 21.58 | .15 | .02 | 13.62 | 0.75 | 3.11 |
| 2 | .002 | 3.21 | 57.87 | 20.81 | .27 | .27 | 13.70 | 0.79 | 2.92 |
| B | .004 | 4.30 | 59.14 | 19.96 | .22 | .26 | 13.16 | 1.09 | .96 |
| C* | .021 | 3.53 | 56.48 | 20.78 | .31 | .26 | 13.74 | 0.78 | 3.22 |
| D | .003 | 3.15 | 58.5 | 20.95 | .20 | .26 | 13.66 | 2.09 | 1.00 |
| E | .004 | 3.18 | 58.44 | 21.05 | .21 | .26 | 13.66 | 1.17 | 1.86 |
| G | .003 | 1.91 | 58.37 | 21.16 | .24 | .25 | 13.68 | 2.09 | 1.99 |

*Contained 0.52% Ta

Four transverse sections were taken from each heat. Three of the sections from each heat were machined, polished to 240 grit and bent at their HAZ's as 2T guided side bends. Alloy 2 did not show any indication of cracking (microfissures) whereas Alloy C depicted 8 HAZ cracks in the side bends. The remaining sections were mounted and polished for metallographic examination and optically examined for microfissures. Alloy 2 exhibited extensive HAZ grain boundary liquations with good back-filling to a length of 0.01 inch into the heat affected zone. No microfissures were observed. Alloy C showed poor back-filling (fissures), the liquation being 0.0175 inch into the HAZ. The grain size was approximately ASTM #4 in each case. It is considered that the carbon content of Alloy C, 0.021%, was high. In striving for best results the carbon content should not exceed 0.015% and preferably not more than 0.01%.

Alloy 1 was examined in the hot-rolled condition and also as follows: 1950° F. (1066° C.)/0.5 hr., WQ; 2100° F. (1149° C.)/0.5 hr., WQ; and 2150° F. (1177° C.)/0.5 hr., WQ. Parameters were: 0.061 dia. Alloy 625 filler metal, 270 amps, 190 in./min. wire speed, 33 volts, 60 cfh argon and fully restrained. Weldments were ground, polished and liquid penetrant tested on the weld face and root. No cracking was noted. Radiographic examination did not reveal cracks. 2T side bends failed to exhibit any cracks. Two transverse metallographic sections were cut, mounted, polished and etched for each weldment and grain size conditions. Grain boundary liquation was from 0.0056 to 0.015 inch into the HAZ and the grain size varied from ASTM #6 to 1.5. No cracks, fissures or lack of back-fill were detected.

Data are tabulated in Tables VII and VIII.

TABLE VII

| Side Bend (2T) Results | | | |
|---|---|---|---|
| Alloy | Grain Size | Bends | Length of HAZ Grain Boundary Liquation, inch |
| 2 | 4 | Good | 0.01 |
| C | 4 | Poor | 0.0175 |

TABLE VIII

| Alloy | Grain Size | Cracks | Length of HAZ Grain Boundary Liquation, inch |
|---|---|---|---|
| 2 | 4 | No | 0.01 |
| C | 4 | Yes | 0.0175 |
| 1 | 1.5–6 | No | 0.015–0.0056 |

Gas metal-arc welding was used to examine Alloys B, E, D and G of Table VI. In this case ⅜ inch strip (⅜"×2" length) was used for test purposes, the strip having been annealed at 2100° F. for ½ hour. The 2T bend test was used, the parameters being: 0.062 inch dia. INCONEL filler metal 625; 270 amps; wire feed 230 in./min., 32 volts and 50 cfh argon shield. Results are given in Table IX.

TABLE IX

| Alloy | Grain Size, ASTM | Side Bend Weld Centered | Side Bend* HAZ Centered | Face Bend Weld Centered |
|---|---|---|---|---|
| B | 4.5 | No Cracks | No Cracks | Numerous Cracks at Fusion Line |
| D | 4 | No Cracks | No Cracks | Numerous Cracks at Fusion Line |
| E | 5 | No Cracks | No Cracks | Mini-cracks at Fusion Line |
| G | 4 | 1,2 Cracks** Approx. 1/16" Long | 1,2 Cracks** Approx. 1/16" Long | No Cracks |

*2 tests per weld
**Cracks at fusion line running into HAZ

As indicated hereinafter, the alloy of the invention is particularly suited as a cladding material to steel. This is indicated by the data presented in Table X. A 2T bend sheet was used to study the effect of carbon diffusion from a carbon steel on Alloys B, D, E and G. While these particular compositions are outside the invention for other reasons, they nonetheless serve to indicate the expected behavior of alloys within the scope of the invention. The heat treatment employed with and without being wired to the carbon steel was adopted to simulate the steel cladding as shown in Table X. Included are data on commercial Alloy C-276.

TABLE X

| Alloy | Material Condition: As-Produced* | Heat Treated to Simulate Steel Cladding**: a. Not wired to C-Steel | b. Wired to C-Steel |
|---|---|---|---|
| B (1Nb,1W) | NC*** | NC | 3 cracks**** |
| D (2Nb,1W) | NC | NC | Multiple cracks**** |
| E (1Nb,2W) | NC | NC | NC |
| G (2Nb,2W) | NC | NC | NC |
| C-276 (commercial sheet) | NC | NC | Multiple cracks**** |

*As-produced material = ¼" strip in the 50% cold worked + 2100 F./15 min/AC condition.
**Heat treatment = 2050 F./30 min/AC + 1100 F./60 min/AC.
***NC = No Cracking.
****Where the specimen touched the steel during heat treatment.
Note: For specimens heat treated wired to C-steel, the surface which contacted the steel was on the outside when bent.

Only the alloys containing nominally 2% tungsten were resistant to surface cracking related to carbon diffusion from the steel.

As indicated above herein, the subject alloy manifests the ability to absorb high levels of impact energy (structural stability) at low temperatures. This is reflected in the data given in Table XI which includes reported data for a commercial alloy corresponding to Alloy A.

TABLE XI

| Alloy | Condition | Test Temp., °F. | Charpy V-Notch Impact Strength, ft-lbs | Comments |
|---|---|---|---|---|
| 1 | Annealed 2100° F. | 72 | — | Did Not Break |
| 1 | Annealed 2100° F. | −320 | — | Did Not Break |
| 1 | Annealed 2100° F. + 1000 hr. at 1000° F., AC | 72 | >240 | Did Not Break |
| 1 | Annealed 2100° F. + 1000 hr. at 1000° F., AC | −320 | >240 | Did Not Break |
| A | Annealed 2050° F. + 1000 hr. at 1000° F., AC | 72 | 259 | Did Not Break |
| A | Annealed 2050° F. + 1000 hr. at 1000° F., AC | −320 | 87 | Broke |

Representative mechanical properties are given in Tables XII, XIII and XIV, Alloy 1 being used for this purpose.

TABLE XII

| Room Temperature Tensile Properties: Annealed Condition | | | | | |
|---|---|---|---|---|---|
| Product | 0.2% Y.S. ksi | T.S. Ksi | % Elong. | Hardness | ASTM Grain Size |
| 0.650" Plate* | 115.3 | 150.0 | 32 | Rc 31 | — |
| 0.650" Plate | 49.2 | 104.6 | 65 | Rc 87 | 2 |
| 0.650" Plate | 45.3 | 102.5 | 70 | Rc 86 | 1–1½ |

*As hot rolled

TABLE XIII

| High Temperature Tensile Properties Annealed 0.250" Plate | | | |
|---|---|---|---|
| Test Temperature °F. | 0.2% Y.S. ksi | T.S. ksi | % Elongation |
| 200 | 41.1 | 98.7 | 67 |
| 400 | 35.2 | 91.7 | 70 |
| 600 | 31.7 | 87.5 | 69 |
| 800 | 29.8 | 85.0 | 68 |
| 1000 | 32.1 | 79.7 | 64 |
| 1200 | 27.6 | 77.0 | 62 |
| 1400 | 29.3 | 69.0 | 53 |

TABLE XIV

| Effect of Aging on Tensile Properties: 0.250" Annealed Plate | | | | |
|---|---|---|---|---|
| Condition | 0.2% Y.S. ksi | T.S. ksi | % Elong. | Hardness |
| As Annealed | 45.3 | 102.5 | 70 | Rb 86 |
| Anneal + 1000° F./ 1000 Hr, AC | 48.5 | 106.6 | 65 | Rb 87 |

The presence of niobium in the weld deposits is considered to aid room temperature tensile strength as reflected in Table XV. Tests were made on a longitudinal section taken through the weld metal.

TABLE XV

| Weld Deposits | | | | | |
|---|---|---|---|---|---|
| Alloy | Y.S. psi | U.T.S. psi | Elongation, % | Reduction of Area, % | Hardness Rb |
| 0.045 Inch Diameter Filler Metal | | | | | |
| 1 | 69,300 | 104,900 | 50.5 | 45.7 | 97-98 |
| 1 | 67,600 | 104,400 | 48.0 | 50.3 | 98-99 |
| A | 65,900 | 98,800 | 52.0 | 62.9 | 97 |
| A | 66,900 | 102,400 | 52.0 | 62.6 | 98-99 |
| 0.125 Inch Diameter Coated Electrode | | | | | |
| 1 | 75,100 | 116,300 | 41 | 36 | 99 |
| A | 72,700 | 107,000 | 46 | 45 | 98 |
| A | 68,100 | 107,600 | 42 | 44 | 95 |

The subject alloy can be formed into a variety of mill products such as rounds, forging stock, pipe, tubing, plate, sheet, strip, wire, etc., and is useful in extremely aggressive environments as may be encountered in pollution-control equipment, waste incineration, chemical processing, processing of radioactive waste, etc. Flue Gas Desulfurization is a particular application (scrubbers) since it involves a severe acid-chloride environment.

As contemplated herein, the term "balance" or "balance essentially" as used with reference to the nickel content does not exclude the presence of other elements which do not adversely affect the basic characteristics of the alloy. This includes oxidizing and cleansing elements in small amounts. For example, magnesium or calcium can be used as a deoxidant. It need not exceed (retained) 0.2%. Elements such as sulfur and phosphorus should be held to as low percentages as possible, say, 0.015% max. sulfur and 0.03% max. phosphorus. While copper can be present it is preferable that it not exceed 1%. The alloy range of one constituent of the alloy can be used with the alloy ranges of the other constituents.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

The embodiments of the invention in which an exclusive property or privilege is claimed are defined as follows:

1. A nickel-base alloy characterized by (a) high degree of corrosion resistance to aggressive corrosive media, particularly in the heat affected zone when welded, (b) good weldability, (c) a high critical crevice corrosion temperature when tested in aqueous ferric chloride solution and (d) structural stability, said alloy consisting essentially of about 19 to 23% chromium, about 12 to 15% molybdenum, about 2.25 to 4% tungsten, about 0.65 to less than 2% niobium, about 2 to 8% iron, up to 0.2% carbon, up to less than 1% manganese, up to less than about 0.5% silicon, up to about 0.5% aluminum, up to about 0.5% titanium, and the balance being nickel together with normal contents of impurities and incidental elements.

2. The alloy set forth in claim 1 containing 20 to 22.5% chromium, 12.5 to 14.5% molybdenum, 2.75 to 4% tungsten, 0.75 to 1.25% niobium, 3 to 6% iron, up to 0.015% carbon, up to 0.5% manganese, up to less than 0.3% silicon, and up to 0.3% each of aluminum and titanium.

3. The alloy set forth in claim 1 in which the niobium is from 0.75 to 1.25%.

4. As a new article of manufacture, a weld deposit structure in which the base metal is formed from the alloy of claim 1.

5. As a new article of manufacture, a weld deposit structure in which the base metal is formed from the alloy of claim 2.

6. A wrought composite metal clad product comprised of a metal cladding bonded to a base metal, said cladding metal being formed from the alloy set forth in claim 1 and wherein the base metal is selected from carbon steels, low and medium alloy steels.

7. A wrought composite metal clad product comprised of a metal cladding bonded to a base metal, said cladding metal being found from the alloy set forth in claim 2 and wherein the base metal is selected from carbon steels, low and medium alloy steels.

* * * * *